United States Patent [19]

Kohl et al.

[11] 4,123,918

[45] Nov. 7, 1978

[54] ICE DISPENSING MACHINE

[75] Inventors: Vance L. Kohl; Walter H. Hoenisch, both of Albert Lea, Minn.

[73] Assignee: King-Seeley Thermos Co., Ann Arbor, Mich.

[21] Appl. No.: 749,036

[22] Filed: Dec. 9, 1976

[51] Int. Cl.[2] ..... B67D 5/62; F25C 5/18

[52] U.S. Cl. ..... 62/320; 222/146 C; 222/168.5; 222/410

[58] Field of Search ..... 62/344, 320; 222/168, 222/168.5, 146 C, 239, 410

[56] References Cited

U.S. PATENT DOCUMENTS

| | | | |
|---|---|---|---|
| 2,942,761 | 6/1960 | Jungmayr | 222/168 X |
| 3,406,871 | 10/1968 | Hoenisch | 222/168 X |
| 3,667,654 | 6/1972 | Holley | 222/410 X |
| 3,796,351 | 3/1974 | Kohl et al. | 222/168 X |

*Primary Examiner*—William E. Wayner
*Attorney, Agent, or Firm*—Harness, Dickey & Pierce

[57] ABSTRACT

An ice dispensing machine comprising a rotatable ice storage bin adapted to have ice from a suitable source thereof deposited therein; an ice shearing blade located below the bin and adapted to shear off ice located within the bin such that said ice is deposited in an ice discharge area; an ice discharge assembly located within the area and including a rotatable member having a plurality of outwardly projecting ice flipper elements operable to cause ice within the discharge area to move toward and into an ice discharge spout, and a control system for selectively operating the bin and the discharge assembly in response to actuation of a control lever which is adapted to be engaged by a suitable ice receiving receptacle, such as a glass or the like, with the control system including cam operated device for selectively positioning the flipper elements at the termination of each of the vend cycles such that one of the flipper elements is covering the inlet end of the discharge spout to prevent any melt water from passing down the spout.

59 Claims, 10 Drawing Figures

FIG. 4.
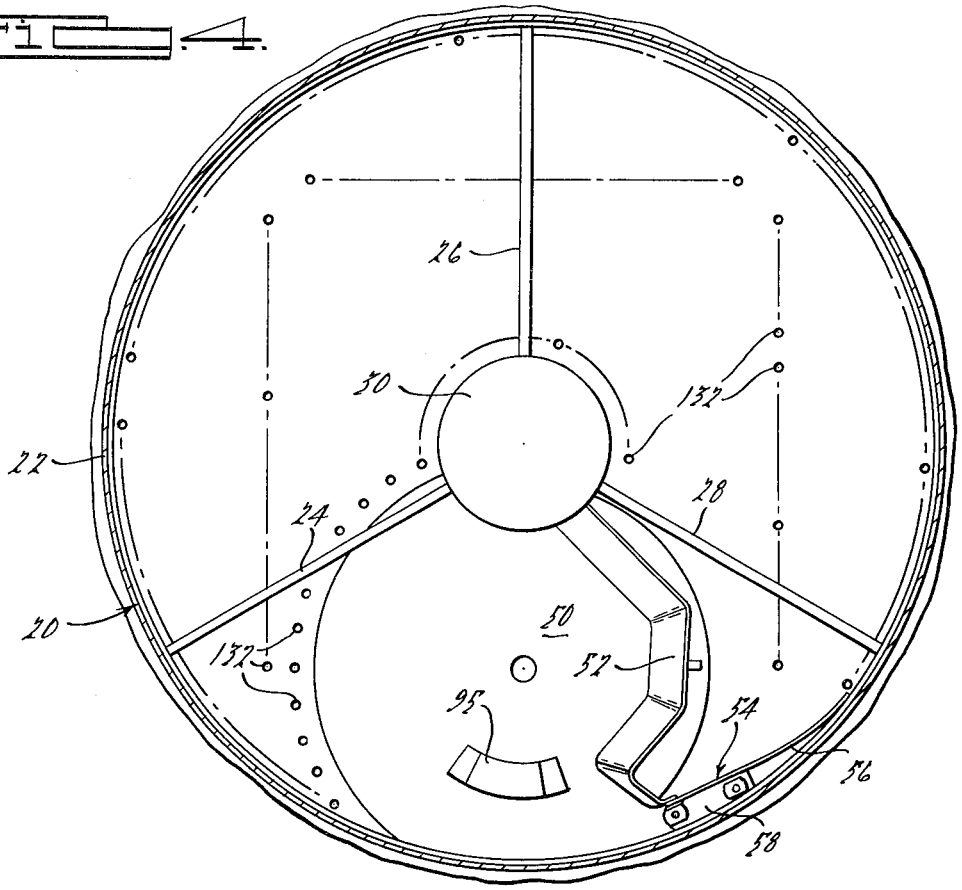
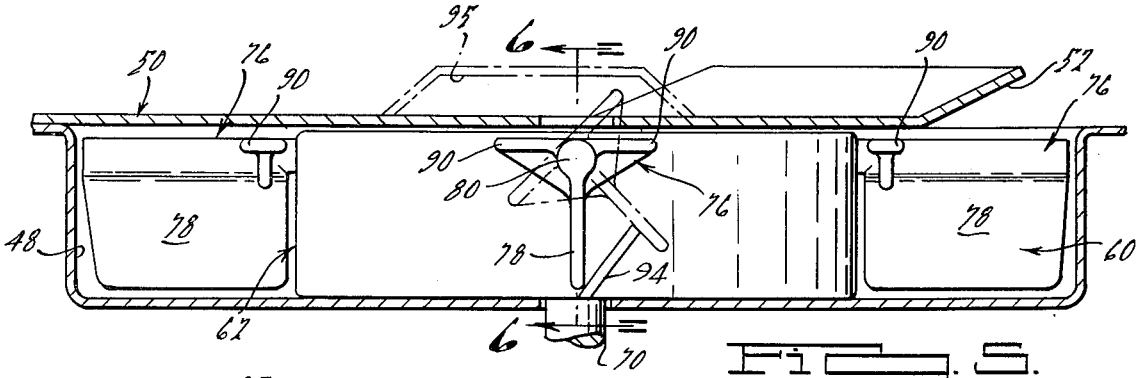
FIG. 5.
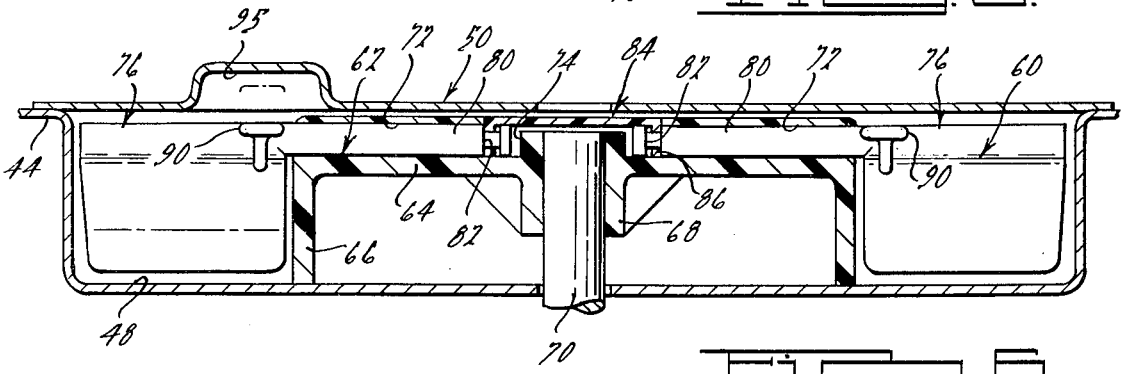
FIG. 6.

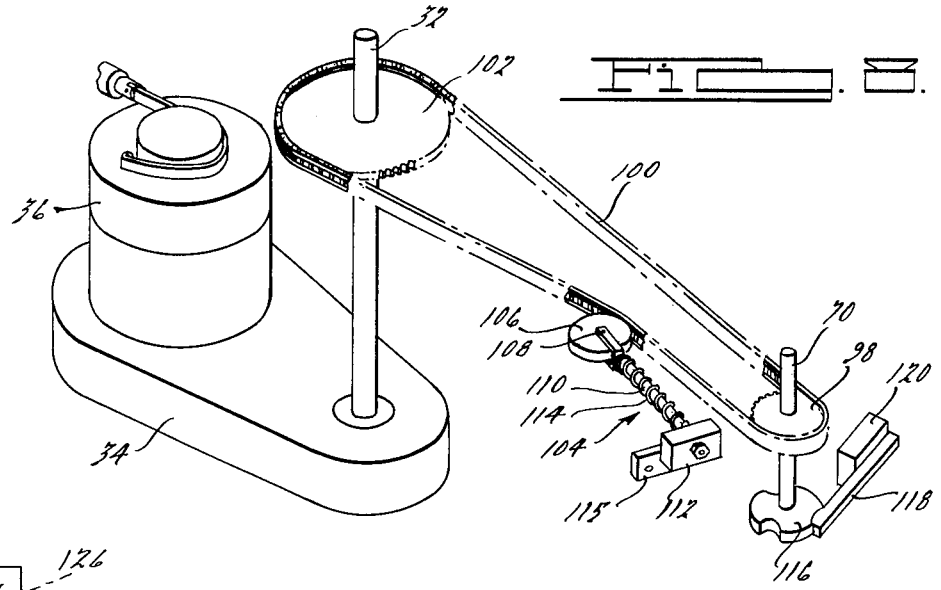
FIG. 8.
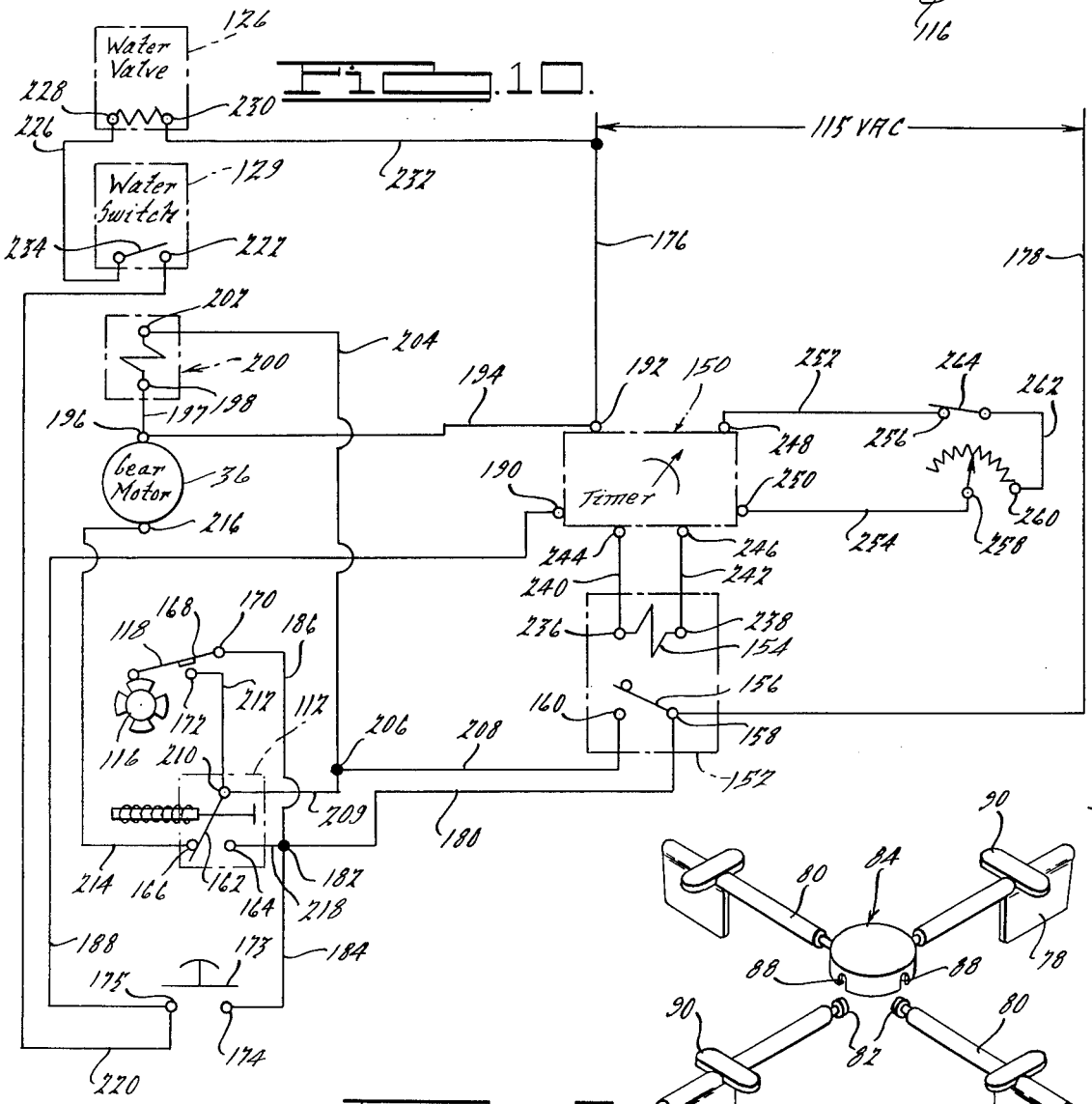
FIG. 10.
FIG. 9.

ICE DISPENSING MACHINE

BACKGROUND AND SUMMARY OF THE INVENTION

Generally speaking, the present invention is directed toward a new and improved ice dispensing machine adapted to dispense flaked, crushed, shaved, or extruded ice in metered quantities. More particularly, the present invention is directed toward a new and improved ice dispensing machine which provides for the positive feed or discharge of ice from a storage bin into a suitable receptacle, such as a glass or the like, and it is accordingly a general object of the present invention to provide a machine of such character.

It is another object of the present invention to provide a new and improved ice dispensing machine of the above type which is provided with improved safety features which assures against damage to the machine in the event the discharge spout becomes blocked or obstructed.

It is a related object of the present invention to provide an ice dispensing machine of the above described type which includes a plurality of ice flipper elements that are rotatably mounted on a rotatable discharge member located below an ice shearing plate, which plate is adapted to shear off ice located within a rotatable bin located thereabove and deposit the ice into the discharge area. Upon rotation of the discharge member, the ice flipper elements will cause the ice within the discharge area to move toward and into a discharge opening which is in turn communicable with a discharge spout that delivers the ice to a receptacle or the like. The drive mechanism for the dispensing machine of the present invention utilizes a cam operated switch and brake arrangement that functions to selectively position the discharge member and hence the respective flipper elements thereon such that one of the flipper elements is located in a position to deflect any melt water away from the discharge spout at the end of each vend cycle, whereby to obviate the dripping of water out of the spout during periods of non-use. Another feature of the present invention resides in the fact that the various component parts of the dispensing machine which come into contact with the ice may be conveniently removed for purposes of cleaning so as to satisfy Federal, State and Municipal sanitation regulations. Accordingly, it is another object of the present invention to provide a new and improved ice dispensing machine which may be conveniently disassembled for purposes of cleaning, inspection and the like.

It is a further object of the present invention to provide an ice dispensing machine of the above described type that is of a relatively simple design and which can be economically manufactured and maintained.

It is still a further object of the present invention to provide a new and improved ice dispensing machine of the above described type which is adapted to simultaneously dispense water or other liquid during each vend cycle.

It is a related object of the present invention to provide a new and improved ice dispensing machine that may be readily adapted to dispense flavored syrups for use in making soft drinks and the like.

Other objects and advantages of the present invention will become apparent from the following detailed description taken in conjunction with the accompanying drawings.

BRIEF DESCRIPTION OF THE DRAWINGS

FIG. 4 is an enlarged fragmentary cross-sectional view taken substantially along the line 4—4 of FIG. 3;

FIG. 5 is an enlarged fragmentary cross-sectional view of the discharge assembly incorporated in the ice dispensing machine of the present invention;

FIG. 6 is a transverse cross-section view taken substantially along the line 6—6 of FIG. 5;

FIG. 8 is an elevated perspective view of a schematic representation of the drive mechanism incorporated in the ice dispensing machine of the present invention;

FIG. 9 is an exploded assembly view of the rotor and flipper components of the discharge assembly shown in FIGS. 5 through 7, and FIG. 10 is a schematic representation of an exemplary electrical circuit which may be incorporated in the ice dispensing machine of the present invention.

DESCRIPTION OF A PREFERRED EMBODIMENT

Figure 1:
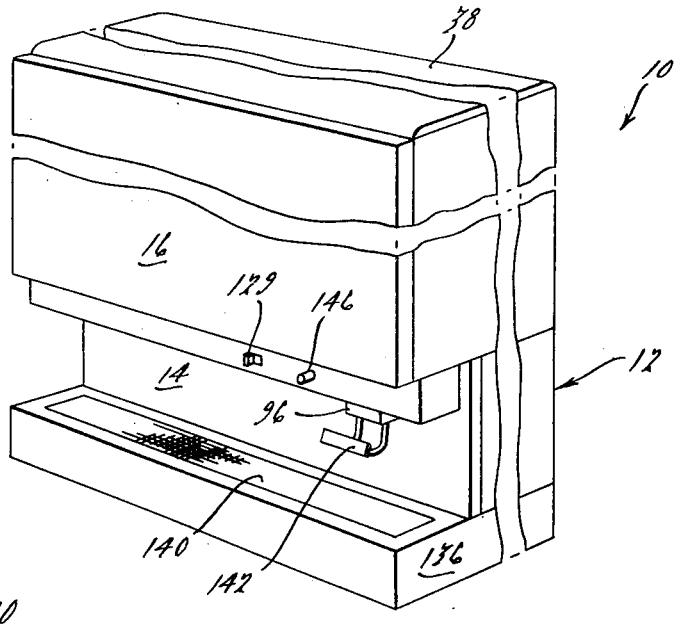
FIG. 1 is an elevated perspective view, partially broken away, of the ice dispensing machine of the present invention.
Figure 3:
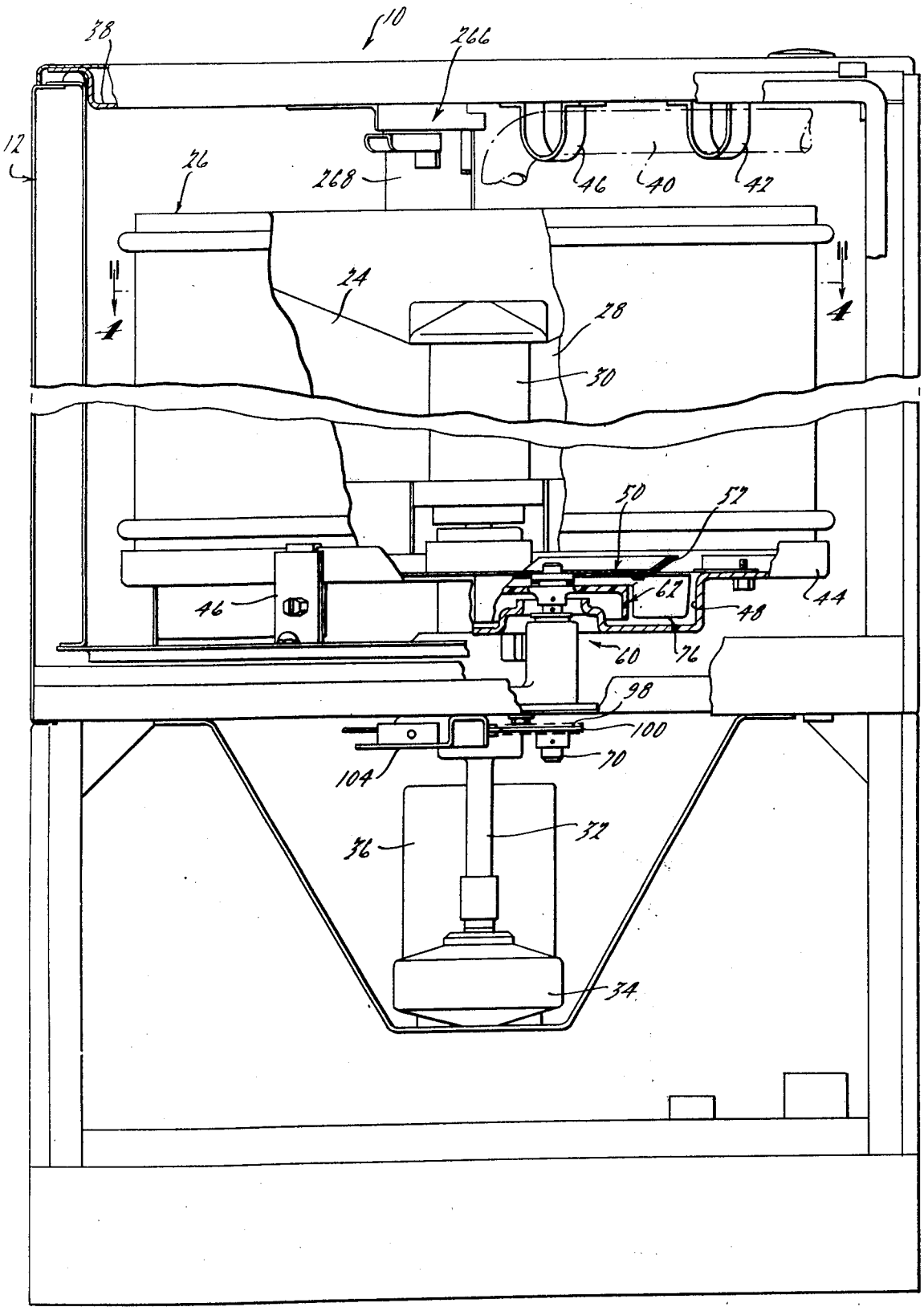
FIG. 3 is an enlarged transverse cross-sectional view of the ice dispensing machine of the present invention.

Referring now in detail to the drawings and in particular to FIG. 1 thereof, an ice dispensing machine 10 in accordance with one preferred embodiment of the present invention, is shown as comprising a generally upright enclosure or housing 12 which is preferably suitably insulated against heat loss and is fabricated of any suitable material, such as stainless steel or the like. The housing 12 comprises an ice receptacle receiving area 14 adjacent the lower front side 16 thereof, and has an ice storage section 18 in the upper end thereof within which a rotatable ice storage bin 20 is located. As best seen in FIGS. 3 and 4, the bin 20 includes an annular side wall 22 and the interior thereof is provided with a plurality of radially extending equally circumferentially spaced vanes or dividers 24, 26 and 28 that terminate at their radially outermost portions adjacent the side wall 22, and at their radially innermost portions adjacent a central hub 30 which supports the ice storage bin 20 for rotation about a generally vertically disposed axis. The storage bin 20 is operatively engaged with the upper end of a generally vertically arranged drive shaft 32 that is driven at the lower end thereof by means of a gear reduction unit 34 which is in turn driven by suitable electrically energized motor 36 (see FIG. 8). The upper end of the enclosure of housing 12 is provided with a suitable removable cover 38, the underside of which is adapted to support an ice delivery conduit 30 by means of suitable conduit support straps or the like 32. Generally speaking, ice in flaked, crushed, extruded or other form is supplied from a suitable ice-making machine through the conduit 30, which ice is deposited into the bin 20 at a rate determined by an ice level control device hereinafter to be described. The motor 36 is selectively energized when ice delivery is desired, whereupon the bin 20 will rotate causing ice to be delivered from the lower end thereof into a suitable receptacle in the receptacle receiving area 14. It is to be noted that the dispensing machine 10 of the present invention, instead of having ice be delivered thereto through the conduit 30, may have a suitable ice-making machine mounted directly upon the upper end thereof, whereupon the ice may be transferred directly out of the ice-making machine into the upper end of the bin 20, as will be apparent to those skilled in the art.

Arranged directly below the storage bin 20 is an annular pan 44 which is fabricated, for example, of a suitable easily molded polymeric material, such as styrene or the like. The pan 44 is operatively supported within the enclosure by means of a plurality of support legs 46, as best seen in FIG. 3. The pan 44 is formed with an ice discharge cavity which is generally circular in shape and is generally designated by the numeral 48. The cavity 48 is located radially outwardly from the center of rotation of the bin 20 and is covered by a ice shearing plate, generally designated by the numeral 50. The plate 50 is formed with an upwardly inclined ice shearing edge 52 which is inclined in the opposite direction from the direction of rotation of the bin 20, whereby the lower most portions of the ice located within the bin 20 will be sheared or shaved off upon rotation. In order to assure against bridging, an ice guide 54 is provided adjacent the ice shearing edge 52. As best seen in FIG. 4, the guide 54 includes an arcuate shaped deflecting portion 56 which extends upwardly away from the upper surface of the pan 34 and is adapted to be secured in place by means of a generally horizontally disposed mounting flange 58. As hereinafter to be described, the ice that is sheared off the mass thereof within the bin 20 by means of the ice shearing edge 52 of the shearing plate 50 is intended to drop downwardly into the ice discharge cavity 48, which ice is thereafter discharged by means of an ice discharge assembly 60 located within the cavity 38.

Figure 7:
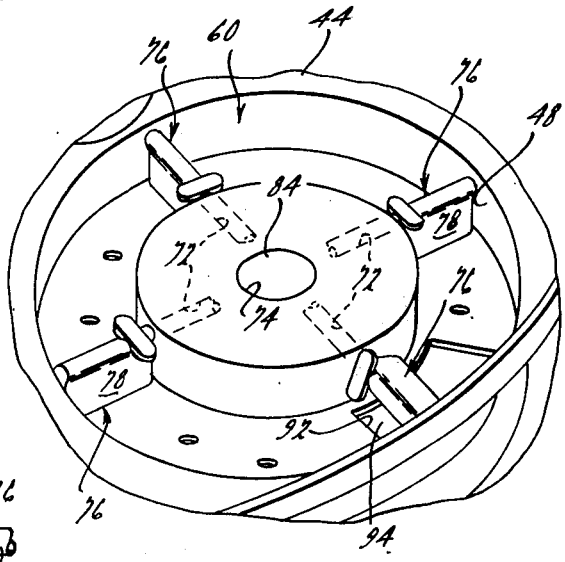
FIG. 7 is an elevated perspective view of the discharge assembly shown in FIGS. 5 and 6.

Referring now in detail to the construction of the ice discharge assembly 60, as best seen in FIGS. 5 to 7, the assembly 60 includes a central rotor member 62 which is located within the cavity 38 and includes a generally flat horizontal upper portion 64 and a downwardly depending peripheral side portion 66. The rotor member 62 includes a central hub section 68 that is operatively engaged with the upper end of a generally vertically disposed drive shaft 70 which will hereinafter be described. The hub section 68 is formed with a plurality of four radially inwardly extending, equally circumferentially spaced bores 72, and with a central coaxially arranged recess 74 in the upper side thereof. The rotor member 62 is adapted to cause rotation of a plurality of four ice flipper elements, generally designated by the numeral 76. As shown in FIG. 6, each of the elements 76 includes a generally blade-like outer end portion 78 that is formed integrally of an elongated shaft section 80, the inner end of which is formed with an annular recess 82. The shaft sections 80 of the elements 76 are adapted to be received one within each of the bores 72 and be journal supported therein, whereby the elements 76 are pivotable or rotatable about the axis of the shaft sections 80 thereof. As shown in FIG. 6, when the sections 80 of the elements 76 are inserted into the bores 72, the annular recesses 82 thereof are aligned with the recess 74 of the hub section 68. Means in the form of an annular keeper element 84 is provided for retaining the element 76 assembled into the rotor member 62. As best seen in FIG. 9, the keeper element 84 is formed with an annular downwardly depending side wall 86 which is formed with four circumferentially spaced semi-circular recesses 88 which are adapted to nestingly receive the inner ends of the shaft sections 80 at the annular recesses 82 thereof. With this arrangement, once the keeper element 84 is assemblied onto the upper side of the rotor member 62, the flipper elements 76 are free to rotate relative to the member 62 but are retained against radial movement within their respective bores 72.

As best seen in FIG. 7, each of the keeper elements 76 is formed with a pair of outwardly projecting ears or shoulders 90 that are located adjacent the outer periphery of the rotor member 62. The shoulders 90 are adapted to bear against the underside of the ice shearing plate 50 during rotation of the rotor 62 and thereby prevent rotation of the flipper elements 76 about the axes of the shaft sections 80 relative to the rotor member 62. Accordingly, upon rotation of the member 62, the elements 76 will rotate around the interior of the ice discharge cavity 38 and cause any ice deposited thereinto to be moved in a circular path around the cavity 58 toward and into a discharge opening 90 which is formed in the pan 34 at the bottom of the cavity 38. An ice scoop 94 extends upwardly through the discharge opening 92 and is adapted to cause the ice keeper elements 76 to rotate or pivot about their respective shaft sections 80 from the solid line position shown in FIG. 5 to the phantom line position shown in this Figure, whereupon the ice which is being biased around the cavity 38 may be scraped from the forward or leading sides of the elements 76 and drop downwardly through the discharge opening 92. It will be noted that the ice shearing plate 50 is formed with an upwardly extending relieved area, as designated by the numeral 95 in FIG. 5, which permits the ears or shoulders 90 of the elements 76 to pivot to the aforesaid phantom line position shown in this Figure. It should be noted, however, that once the elements 76 rotate beyond the relieved section 95, the ears or shoulders 90 thereof will cause the blade-like outer ends 78 to again assume a generally vertical orientation.

Figure 2:
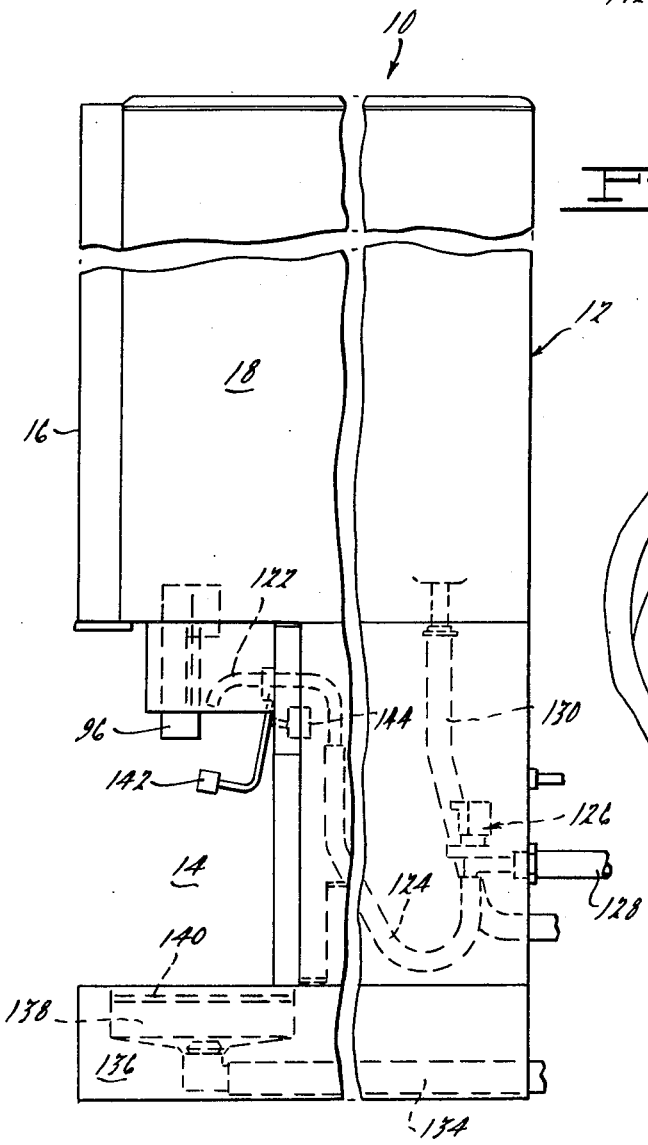
FIG. 2 is a side elevational view, partially broken away, of the ice dispensing machine shown in FIG. 1.

It will be seen from the foregoing that upon rotation of the ice storage bin 20, ice within the bin 20 will be sheared by the shearing edge 52 and will then drop downwardly into the ice discharge cavity 48. Rotation of the rotor member 62 and plurality of elements 76 will cause the ice which is thus deposited into the cavity 62 to be rotated around the cavity 48 to a position wherein the ice is scraped off of the forward sides of the elements 76 by the ice scoop 94. The ice which is removed from the elements 76 drops through the discharge opening 92 and into a discharge spout 96, the outer end of which is shown in FIG. 2 as being located in the upper end of the ice receptacle receiving area 14, whereupon ice may be deposited to a suitable ice receptacle in a manner hereinafter to be described.

Rotation of the rotor member 62 is, as previously mentioned, caused by rotation of the drive shaft 70, which shaft 70 is, as best seen in FIG. 8, provided with a gear or sprocket 98 adapted to be driven by a suitable drive chain or the like 100 that is in turn driven by a sprocket 102 mounted on the aforementioned drive shaft 32. The size and number of teeth on the sprockets 102 and 98 are designed such that during a normal dispensing operation, the ice storage bin 20 will rotate at approximately six revolutions per minute, whereas the rotor member 62 and plurality of ice flipper elements 76 will rotate at approximately 32 revolutions per minute. It will be appreciated, of course, that alternative speed ratios may be utilized, although the aforesaid ratios have been found to be highly satisfactory.

Because of the positive downward force which the discharge assembly exerts on the ice as it is forced into the discharge spout 96, in the event the spout 96, for some reason or another, becomes closed, or blocked, it is possible that the machine could be severely damaged. Accordingly, it may be desirable to provide an overload mechanism such as is generally designated at 104 into the control system of the ice dispensing machine 10 of the present invention. As shown in FIG. 8, the overload mechanism 104 includes a roller element 106 which is rotatably supported by means of a suitable clevis 108 and is adapted to ride along the normally slack side of the drive chain 100. In the event the torque on the chain 100 increases, the chain will become taut and will bias the roller element 106 outwardly. This, in turn, will bias a shaft 110 supporting the clevis 108 toward a position effecting actuation of an electrical overload switch 112. The shaft 110 is normally spring biased toward the chain 100 by means of a suitable spring 114 located coaxially of the shaft 112 so that the switch 112 will not be actuated until such time as the force of the spring 114 is overcome. The switch 112 is provided with a reset button 115 that is connected in the electric circuitry of the machine 10 such that upon actuation of the switch 112, the electric circuit to the motor 36 will be opened, thereby effecting de-energization of the motor to prevent any damage to the machine. Once the spout 96 becomes cleared, the reset button 115 may be actuated to again complete the electrical circuit to the motor 36 so that normal operation of the machine 10 may be resumed.

In the event it is desired to positively prevent the discharge of melt water through the discharge spout 96, it may be desirable to provide a cam actuated positioning switch in a control system of the ice dispensing machine 10 in the present invention. In particular, it may be desired to provide a cam 116 on the drive shaft 70 for cooperation with a cam follower 118 which operates a control switch 120. The cam 116 is formed with a plurality of four lobes which are equally circumferentially spaced therearound and are adapted to assure that the rotor member 62 will be rotated to a predetermined distance after de-energization of the machine 10 at the end of each vend cycle so as to position one of the flipper elements 76 as shown in FIG. 5 over the discharge opening 92, whereby any melt water will be deflected away from the opening 92 and hence will not drip down the discharge spout 96, as will be described in connection with the overall operation of the machine 10. It is noted that when the cam 116 and switch 120 are utilized, it is desirable to provide an electrically energized brake on one of the machine's drive shafts 70 which assures for positive stopping of the operating mechanism so as to provide for precise alignment of the respective flipper elements 76 over the discharge opening 92.

In the event it is desirable to provide for the simultaneous dispensing of the water and ice during each vend cycle, the machine 10 may be provided with a water spout 142 which, as shown in FIG. 2, is located directly adjacent the ice discharge spout 96. The spout 122 is connected by a suitable water line 124 with an electrically energized water valve, generally designated by the numeral 126. The valve 126 may be connected to any suitable source of potable water through a suitable supply line 128 connected to the rearward side of the machine 10 as illustrated. A suitable manually actuatable electrical water switch 129 is preferably mounted on the front face 116 of the housing 112 which, when actuated, will provide for the communication of electrical energy to the water valve 126 so that the valve 126 will be actuated to the open position simultaneously with the dispensing of ice during the ice vend cycle. When the switch 129 is deactuated, the water dispensing feature of the machine 10 will remain temporarily inoperative so that only ice will be dispensed.

In order to provide for the discharge of melt water and the like, the ice dispensing machine 10 is provided with a drain line 130 which, as best seen in FIG. 2, is communicable with the underside of the pan 34 and any melt water which accumulates within the pan 34 is intended to circulate through a multiplicity of discharge ports 132 that are representatively illustrated in FIG. 4. An additional drain line 134 is communicable with a sink area 136 located directly below the ice receptacle receiving area 14 and is provided with a water basin 138 which is covered by suitable grate or the like 130. The drain lines 130 and 134 may be communicable with any suitable drain which is available in the vicinity of the installation location of the machine 10, as will be apparent to those skilled in the art.

Referring now to the control system of the ice dispensing machine 10 of the present invention, as best seen in FIGS. 1 and 2, a receptacle engaging control lever 142 is pivotally mounted within the area 14 and is adapted to be engaged by a suitable receptacle, such as a glass or the like, in order to initiate operation of a vend cycle. The lever 142 is located directly rearwardly of the discharge spouts 96 and 122 so that when a receptacle is engaged therewith, such receptacle will be in a proper position to receive only ice, or ice and water, from the spouts 96, 122. The lever 142 is adapted to effect actuation of a vend control switch 144 which is located directly adjacent thereto and is cooperable with a vend cycle timer mechanism which includes a potentiometer 146 and associated control switch 148 that are adapted to be selectively adjusted to control the duration of each vend cycle and hence the volume of ice deposited in the receptacle during a vending operation. As best seen in FIG. 1, the potentiometer 146 may be mounted directly upon the front side 16 adjacent the water switch 129. The control system for the machine 10 also includes an electric timer 150, a relay 152 having an energizable coil 154 which effects operation of the relay armature 156 in order to selectively connect terminals 158 and 160. As shown in FIG. 10, the overload switch 112 cooperates with armature 162 which is selectively actuatable between terminals 164 and 166 upon movement of the shaft 110, as previously described. Cam switch 120 includes an armature 168 which is movable between terminals 170 and 172 upon rotation of the cam 116. The vend switch 144 includes an armature 173 which is selectively movable to a position to complete this circuit between terminals 174 and 175 upon actuation of the lever 142.

An examplary electrical circuit for the ice dispensing machine 10 includes primary conductors 176 and 178 which are adapted to be connected to a suitable source of 115 volt A.C. power. Conductor 178 is connected to terminal 158 which is in turn connected via conductor 180 with terminal 182. Terminal 182 is connected via conductors 184 and 186 with terminals 174 and 170, respectively. Terminal 175 is connected via conductor 188 with terminal 190 of the timer 150. Primary conductor 176 is connected to terminal 192 of the timer 150, which terminal 192 is connected via conductor 194 with terminal 196 of the gear motor 36. Terminal 196 is connected via conductor 197 with terminal 198 of the brake motor 200 which also has terminal 202 which is connected via conductor 204, terminal 206 and conductor 208 with terminal 160. Terminal 206 is connected through conductor 209 with terminal 210 of the overload switch 112, with terminal 210 being communicable via conductor 212 with terminal 172 of the cam switch. Terminal 166 of the overload switch 112 is connected via conductor 214 with terminal 216 of the gear motor 36, and terminal 164 of the switch 112 is connected to the aforementioned terminal 182 via conductor 218. Terminal 175 of the vend switch 144 is connected via conductor 220 with terminal 222 of the water switch 129. The switch 129 includes an armature 234 for completing a circuit between terminal 222 and conductor 226 which is connected to terminal 228 of the water valve 126. The valve 126 also includes terminal 230 which is connected via conductor 232 with the primary conductor 176. The coil 154 of the relay 152 includes terminals 236 and 238 which are connected via conductors 240 and 242 with terminals 244 and 246, respectively of the electric timer 150. The timer 150 also includes terminals 248 and 250 which are connected via conductors 252 and 254 with terminals 256 and 258 of the potentiometer switch 146. The switch 146 also includes terminal 260 which is connected via conductor 262 with a switch armature 264. The control circuit of the dispensing machine 10 of the present invention is completed through the provision of an ice level control, generally designated by the numeral 266 which is located adjacent the upper end of the ice storage bin 20 and includes an ice engaging element 268 adapted to engage the upper level of ice deposited into the bin 20, whereby to transmit a control signal to the associated ice making machine to cease communicating additional ice to the bin 20. At such time that the ice level within the bin 20 drops below a predetermined magnitude, the ice level control 266 will again transmit a signal to the ice making machine to begin operation and replenish the quantity of ice within the bin 20.

A typical operational or vend cycle of the ice dispensing machine of the present invention is initiated by engaging the lever 142 with a suitable receptacle, such as a water glass or the like. Actuation of the lever 142 causes the armature 173 to complete a circuit between terminals 174 and 175, whereupon a circuit is completed from primary conductor 178 through conductor 180, conductor 184, conductor 188 to the electric timer 150. This causes the timer to instantly energize the coil 234 of the relay 152 via conductors 240 and 242. When the relay 152 is thus energized, the armature 156 will move to a closed position, thereby completing a circuit between terminals 158 and 160 and hence between conductors 178 and 208. This circuit is continued via terminal 210, armature 162 and terminal 166 of the overload switch 112 and continues to the motor 36 via conductor 214 which, by virtue of being connected via conductor 194 and terminal 192 with the primary conductor 176, will become energized. Energization of the motor 36 will, as previously described, effect rotation of the ice storage bin 20 and simultaneous rotation of the rotor 62 and a plurality of flipper elements 76 causing ice to be discharged into the spout 98, as above described. Rotation of the drive shaft 70 will effect concomitant rotation of the cam 116 which will cause the cam follower 118 to fall into one of the slots or lobes of the cam 116. When this occurs, the armature 168 will complete a circuit between terminals 170 and 172, whereupon a circuit will be completed from terminal 182 via conductor 186, armature 168 and conductor 212 to terminal 210, armature 162 and terminal 166 and thereby maintain the motor 36 energized regardless of the contact position of the vend switch 144, i.e., regardless of whether or not the armature 173 completes a circuit between terminals 174 and 175. If the contacts of the relay 152 are open when the cam switch lifts out of one of the slots on the cam 116, the motor 36 will become immediately de-energized, regardless of whether or not the armature 173 of the vend switch 144 is in the closed position. The reason for this is that the timer may be adjusted to approximately 0.5 seconds to 3.0 seconds, dependent upon the relative adjustment of the potentiometer 146. The more resistence through the potentiometer 146, the longer will be the timing delay. This is, when power is applied to terminals 190 and 192 of the electric timer, the coil 234 of the relay will be instantaneously energized. After the time delay, the timer will deenergize the relay coil 234 and even if power is continuously applied to the terminals 190, 192, the relay will not reoperate until such time as the power is initially released. The potentiometer 146 is designed such that it can be rotated to an extreme position which effects opening the circuitry to the resistance of the potentiometer, with the result that the timer cannot time out. Consequently, the motor 36 will run continuously as long as the vend switch 134 is held closed, i.e., the armature 173 is disposed in position completing a circuit between the terminals 174 and 175. The motor 36 will run continuously so as to rotate the cam 116 as long as the contacts or terminals 158, 160 are closed via the armature 156. If the armature 156 moves to the open position completing a circuit between the terminals 158 and 160, the motor 36 will continue to operate through the cam switch 120 until the follower 118 is biased out of the next successive slot in the cam 116, which slots or lobes are oriented relative to the shaft 70 such that one of the flipper elements 76 is oriented over the discharge opening 92, as above described. As illustrated, the brake motor 200 will stop rotation of the driveshaft 32 as soon as the motor 36 is de-energized. When the motor 36 is energized, the solenoid of the brake motor 200 is also energized which holds the brake in a released condition to permit rotation of the shaft 32 and hence rotation of the shaft 70. In the event the outlet spout 96 becomes blocked so that ice cannot be ejected, the tension on the drive chain 100 will be such as to effect actuation of the overload switch 112 which results in the armature 162 moving from the position completing a circuit between terminals 210 and 166 to a position completing a circuit between terminals 210 and 164. This opens the circuit to the gear motor 36 but maintains the brake motor energized so as to assure that the brake is not actuated. The reason for this is that it is desirable to let the gear motor cam 116 back off to relieve the tension on the drive chain 100. The overload switch 112 will remain in this condition until the reset switch 115 is actuated, at which time the armature 162 will move to a position again completing a circuit between the terminals 210 and 166.

As previously mentioned, in the event it is desired to dispense water simultaneously with ice, the water switch 126 is actuated so that the armature 224 thereof will complete a circuit between conductor 226 and terminal 222, whereupon energization of the gear motor 36 upon actuation of the vend switch 144 will cause simultaneous actuation of the water valve 126 and hence water will be discharged through the water spout 122 at the same time ice is being dispensed through the discharge spout 96.

A particular feature of the present invention resides in the fact that all of the component parts which come into contact with the ice can be readily removed for purposes of cleaning and without requiring special tools. In particular, the cover 38 may be conveniently removed by removing the top of the housing 12, and the ice storage bin 20 can be conveniently lifted out. A suitable retaining pin (not shown) may be removed from the upper end of the driveshaft 70 to permit lifting off of the ice shearing plate 50, after which time the rotor member 62 may be lifted out along with the ice flipper element 76 attached thereto. Upon removal of the keeper element 84 from the rotor 62, the plurality of flipper elements 76 may be easily removed therefrom. The bottom pan 34 may be conveniently removed by releasing suitable thumb screws or the like so that the pan 34 may be lifted out of the enclosure 12 for cleaning. Similarly, the discharge spout 96 may be conveniently removed, as can be ice scoop 94.

Another feature of the present invention resides in the fact that the ice dispensing machine 10 may be utilized with extruded, shaved, chipped, or crushed ice and may be located either directly adjacent the associated ice making machine or may be located remote therefrom. Additionally, the particular design of the enclosure 12 permits the provision of additional dispensing nozzles or spouts adjacent the ice receptacle receiving area, whereby flavored syrups or the like may be simultaneously dispensed with the ice. Of course, one of the primary features of the present invention resides in the fact that ice will be discharged in a positive manner, whereby to accommodate for dry, chunky, wet, slushy or ice of other qualities. To protect the machine from mechanical damage, the overload switch is provided whereby to effect de-energization of the gear motor in the event the discharge spout becomes blocked. It is to be noted that the machine incorporates an additional safety feature in that the inner end of the discharge spout is open so that in the event the outlet end of the spout becomes blocked, ice is permitted to spill back into the interior of the discharge area. An additional feature of the present invention resides in the fact that the machine may be constructed of readily available materials which may be fabricated in accordance with well known manufacturing techniques. Additionally, because of the relatively simple design, manufacturing and operational expenses will be minimized to the extreme.

While it will be apparent that the embodiment illustrated herein is well calculated to fulfill the objects above stated, it will be appreciated that the present invention is subject to modification, variation and change without departing from the scope and fair meaning of the invention.

We claim:

1. A material dispensing apparatus comprising a material storage section, a material discharge section including means defining a discharge path for communicating material toward a delivery area, a discharge member having at least one material moving element mounted thereon for causing material within said discharge section to be dispensed from the apparatus, said material moving element being mounted on said discharge member for movement between a first position for moving material toward said discharge path and a second position for causing material to move along said path toward said delivery area, and means for rotatably supporting said material storage section and said discharge member upon parallel axes.

2. The invention as set forth in claim 1 wherein said storage section comprises a rotatable storage bin.

3. The invention as set forth in claim 2 which includes a shearing element disposed below said bin for causing material within said bin to be sheared and drop into said discharge section.

4. The invention as set forth in claim 1 wherein said discharge member is rotatably mounted within said apparatus.

5. The invention as set forth in claim 1 wherein said material moving element is rotatably mounted on said discharge member, and wherein the rotational axis of said discharge member is arranged parallel to the axis of rotation of said bin.

6. The invention as set forth in claim 4 which includes a plurality of relatively movable elements rotatably mounted on said discharge member.

7. The invention as set forth in claim 1 wherein said material moving element comprises a material engaging face and means for selectively maintaining said face at generally right angles to the direction of movement of said element within said material discharge section.

8. The invention as set forth in claim 7 which includes means for selectively permitting said element to move toward a position wherein said face thereof is generally parallel to the direction of movement of said member within said discharge section.

9. The invention as set forth in claim 8 which includes a discharge opening for communicating material from said discharge section to said discharge path.

10. The invention as set forth in claim 1 wherein said discharge member comprises a rotor member, which includes a plurality of material moving elements arranged circumferentially around said rotor member and extending radially outwardly therefrom, and which also includes means rotatably supporting each of said elements upon said rotor member.

11. The invention as set forth in claim 2 which includes a pan member disposed below said material storage section, said pan member defining a cavity having a discharge opening formed therein which communicates with said discharge path.

12. The invention as set forth in claim 11 which includes a shearing plate disposed adjacent said cavity and defining a shearing edge which acts to shear material within said storage section such that said material will drop into said cavity.

13. The invention as set forth in claim 12 which includes a rotor member rotatably mounted within said cavity, said rotor member having a plurality of radially outwardly extending circumferentially spaced elements for causing material within said cavity to move toward said discharge opening.

14. The invention as set forth in claim 13 which includes a member covering the upper side of said cavity and which includes shoulder means on said elements cooperable with said cover member for selectively orienting said elements such that material engaging faces of said elements are arranged at generally right angles to the direction of movement of said elements within said cavity, said cover member having a relieved area permitting selective rotational movement of said elements within said cavity.

15. The invention as set forth in claim 4 which includes an electrically energized drive motor and means responsive to the back pressure of material flowing along said discharge path for selectively opening and closing an electric circuit to said motor.

16. The invention as set forth in claim 15 wherein said last mentioned means comprises an overload switch which opens the electrical circuit to said drive motor in the event the back pressure of the material moving along said discharge path exceeds a predetermined magnitude.

17. The invention as set forth in claim 1 which includes cam means for selectively orienting said discharge members such that said material moving element prevents the movement of liquid along said discharge path at the end of each vend cycle.

18. In an apparatus for dispensing ice in flaked, crushed, shaved or similar form, a relatively rotatable ice moving member, a relatively rotatable ice discharge member rotatable about an axis different from but generally parallel to the axis of rotation of said first mentioned member, an ice moving element mounted on said discharge member and rotatable about an axis different from the axis of rotation of both said first and second members, means for simultaneously rotating said ice moving member and said ice discharge member for causing ice to be moved from a storage area toward a delivery area, and means for selectively rotating said ice moving element members for causing ice to be moved along a delivery path toward an ice receptacle.

19. The invention as set forth in claim 18 wherein said first member comprises a rotatable storage bin.

20. The invention as set forth in claim 19 which includes a shearing element disposed below said bin for causing ice within said bin to be sheared and move toward said delivery area.

21. The invention as set forth in claim 18 which includes a plurality of relatively movable ice moving elements rotatably mounted on said discharge member.

22. The invention as set forth in claim 19 which includes a pan member disposed below said first member, said pan member defining an annular cavity having a discharge opening formed therein which communicates with said delivery path.

23. The invention as set forth in claim 22 which includes a shearing plate disposed adjacent said cavity and defining a shearing edge which acts to shear ice within said first member such that said ice will drop into said cavity.

24. The invention as set forth in claim 23 which includes a rotor member rotatably mounted within said cavity, said rotor member having a plurality of radially outwardly extending circumferentially spaced elements for causing ice within said cavity to move toward said discharge opening.

25. The invention as set forth in claim 24 which includes a member covering the upper side of said cavity and which includes shoulder means on said elements cooperable with said cover member for selectively orienting said elements such that material engaging faces thereof are arranged at generally right angles to the direction of movement of said elements within said cavity, said cover member having a relieved area permitting selective rotational movement of said elements within said cavity and about the respective rotational axes of said elements whereby ice within said cavity will be transferred toward and into said discharge opening.

26. The invention as set forth in claim 18 which includes an electrically energized drive motor and means responsive to the back pressure of material flowing along said delivery path for selectively opening and closing an electric circuit to said motor.

27. The invention as set forth in claim 26 wherein said last mentioned means comprises an overload switch which opens the electrical circuit to said drive motor in the event the back pressure of the material moving along said delivery path exceeds a predetermined magnitude.

28. The invention as set forth in claim 18 which includes cam means for selectively orienting said discharge member such that said ice moving element prevents the movement of any melt water along said delivery path at the end of each vend cycle.

29. An ice dispensing machine comprising an ice storage bin for receiving a quantity of ice from a source thereof, means for moving the ice in said bin and an ice shearing element relative to one another whereby ice will be deposited in an ice discharge area, means defining an ice discharge path communicating a discharge area with an ice receptacle receiving area, and an ice discharge assembly for causing ice in said discharge area to be moved toward and along said path in a first direction and without preventing the movement of ice in the opposite direction along said path in the event said path becomes obstructed, said discharge assembly comprising a rotor member, a plurality of material moving elements arranged circumferentially around said rotor member and extending radially outwardly therefrom, and means for rotatably supporting each of said elements upon its own rotational axis relative to said rotor member.

30. The invention as set forth in claim 29 wherein said storage bin is rotatable.

31. The invention as set forth in claim 29 wherein said assembly includes an ice moving element rotatably mounted upon a relatively rotatable discharge member, and wherein the rotational axis of said discharge member is arranged parallel to a second axis of rotation about which said bin is rotatable.

32. The invention as set forth in claim 31 which includes a plurality of ice moving elements rotatably mounted on said discharge member.

33. The invention as set forth in claim 31 wherein said ice moving elements comprise ice engaging faces, and which includes means for selectively maintaining said faces at generally right angles to the direction of movement of said elements within said material discharge area.

34. The invention as set forth in claim 33 which includes means for selectively permitting said elements to move to a position wherein said faces thereof are generally parallel to the direction of movement of said elements within said discharge area.

35. The invention as set forth in claim 34 which includes a discharge opening for communicating material from said discharge area to said discharge path.

36. The invention as set forth in claim 29 wherein said discharge assembly comprises a rotor member, which includes a plurality of material moving elements arranged circumferentially around said rotor member and extending radially outwardly therefrom, and which includes means rotatably supporting each of said elements upon its own rotational axis relative to said rotor member.

37. The invention as set forth in claim 29 which includes a pan member disposed below said bin, said pan member defining a cavity having a discharge opening formed therein which communicates with said discharge path.

38. The invention as set forth in claim 37 which includes a shearing plate disposed adjacent said cavity and defining a shearing edge which acts to shear ice within said bin such that said ice will drop into said cavity.

39. The invention as set forth in claim 38 which includes a rotor member rotatably mounted within said cavity, said rotor member having a plurality of radially outwardly extending circumferentially spaced elements for causing material within said cavity to move toward said discharge opening.

40. The invention as set forth in claim 37 which includes a member covering the upper side of said cavity and which includes shoulder means on said elements cooperable with said cover member for selectively orienting said elements such that material engaging faces of said elements are arranged at generally right angles to the direction of movement of said elements within said cavity, means permitting selective rotational movement of said elements within said cavity and about the respective rotational axis of said elements whereby material within said cavity will be transferred toward and into said discharge opening.

41. The invention as set forth in claim 29 which includes an electrically energized drive motor and means responsive to the back pressure of material flowing along said discharge path for selectively opening and closing an electric circuit to said motor.

42. The invention as set forth in claim 41 wherein said last mentioned means comprises an overload switch which opens the electrical circuit to said drive motor in the event the back pressure of the material moving along said discharge path exceeds a predetermined magnitude.

43. The invention as set forth in claim 29 wherein said discharge path is defined by a discharge spout having a first end portion adapted to dispense the material into a suitable receptacle or the like and a second end portion which is open to permit material flowing along said spout to back up into the interior of said machine in the event a blockage or obstruction exists within said spout.

44. The invention as set forth in claim 29 which includes means for selectively dispensing a fluid concomitantly with ice.

45. The invention as set forth in claim 29 which includes means for rotatably supporting said bin and said discharge assembly along parallel axes.

46. The invention as set forth in claim 40 which includes control means for selectively orienting said material moving elements at the end of each vend cycle so as to prevent undesirable movement of melt water along said discharge path between vend cycles.

47. The invention as set forth in claim 46 which includes cam means for selectively orienting said rotor such that one of said material moving elements prevents the movement of any melt water along said discharge path at the end of each vend cycle.

48. An ice dispensing machine comprising a rotatable ice storage bin, means for removing ice from within said bin and depositing said ice into a discharge area, an ice discharge path for communicating ice in said area toward an ice receptacle receiving area, a discharge assembly including a first rotatable member for moving ice in said discharge area toward said path and a second rotatable member mounted on said first member for causing ice to be moved out of said area and into said path, and means for selectively positioning at least one of said rotatable members at a position such that a melt water is prevented from passing along said path toward said receptacle area.

49. A material dispensing apparatus comprising a material storage section, a material discharge section including means defining a discharge path for communicating material toward a delivery area, a discharge member having at least one material moving element mounted thereon for causing material within said discharge section to be dispensed from the apparatus, said material moving element being mounted on said discharge member for movement between a first position for moving material toward said discharge path and a second position for causing material to move along said path toward said delivery area, said discharge path being defined by a discharge spout having an outlet end portion adapted to dispense the material into a suitable receptacle or the like and an inlet end portion which permits material flowing along said spout to back up into the interior of said apparatus in the event a blockage or obstruction exists within said spout.

50. A material dispensing apparatus comprising a material storage section, a material discharge section including means defining a discharge path for communicating material toward a delivery area, a discharge member having at least one material moving element mounted thereon for causing material within said discharge section to be dispensed from the apparatus, said material moving element being mounted on said discharge member for movement between a first position for moving material toward said discharge path and a second position for causing material to move along said path toward said delivery area, and means for selectively dispensing a fluid concomitantly with said material.

51. A material dispensing apparatus comprising a material storage section, a material discharge section including means defining a discharge path for communicating material toward a delivery area, a discharge member having at least one material moving element mounted thereon for causing material within said discharge section to be dispensed from the apparatus, said material moving element being mounted on said discharge member for movement between a first position for moving material toward said discharge path and a second position for causing material to move along said path toward said delivery area, and means for selectively orienting said material moving element at the end of each vend cycle so as to prevent undesirable movement of any material along said discharge path between vend cycles.

52. In an apparatus for dispensing ice in flaked, crushed, shaved or similar form, a first relatively rotatable ice moving member, a second relatively rotatable ice moving member rotatable about an axis different from the axis of rotation of said first mentioned member, a third relatively rotatable ice moving member rotatable about an axis different from the axis of rotation of both said first and second members, means for simultaneously rotating two of said members for causing ice to be moved from a storage area toward a delivery area, and means for selectively rotating the other of said members for causing ice to be moved along a delivery path toward an ice receptacle, said third member comprising a material engaging face and means for selectively maintaining said face at generally right angles to the direction of movement of said third member.

53. The invention as set forth in claim 52 which includes means for selectively permitting said third member to move to a position wherein said face thereof is generally parallel to the direction of movement of said third member.

54. The invention as set forth in claim 53 which includes a discharge opening for communicating material to said delivery path.

55. In an apparatus for dispensing ice in flaked, crushed, shaved or similar form, a first relatively rotatable ice moving member, a second relatively rotatable ice moving member rotatable about an axis different from the axis of rotation of said first mentioned member, a third relatively rotatable ice moving member rotatable about an axis different from the axis of rotation of both said first and second members, means for simultaneously rotating two of said members for causing ice to be moved from a storage area toward a delivery area, means for selectively rotating the other of said members for causing ice to be moved along a delivery path toward an ice receptacle, said second member comprising a rotor member and said third member comprising one of a plurality of material moving elements arranged circumferentially around and rotatably supported on said rotor member and extending radially outwardly therefrom.

56. In an apparatus for dispensing ice in flaked, crushed, shaved or similar form, a first relatively rotatable ice moving member, a second relatively rotatable ice moving member rotatable about an axis different from the axis of rotation of said first mentioned member, a third relatively rotatable ice moving member rotatable about an axis different from the axis of rotation of both said first and second members, means for simultaneously rotating two of said members for causing ice to be moved from a storage area toward a delivery area, and means for selectively rotating the other of said members for causing ice to be moved along a delivery path toward an ice receptacle, said delivery path being defined in part by a discharge spout having a first end portion adapted to dispense the material into a suitable receptable or the like and a second end portion which is open to permit ice flowing along said spout to back up into the interior of said apparatus in the event a blockage or obstruction exists within said spout.

57. In an apparatus for dispensing ice in flaked, crushed, shaved or similar form, a first relatively rotatable ice moving member, a second relatively rotatable ice moving member rotatable about an axis different from the axis of rotation of said first mentioned member, a third relatively rotatable ice moving member rotatable about an axis different from the axis of rotation of both said first and second members, means for simultaneously rotating two of said members for causing ice to be moved from a storage area toward a delivery area, means for selectively rotating the other of said members for causing ice to be moved along a delivery path toward an ice receptacle, and means for selectively dispensing a fluid concomitantly with said ice.

58. In an apparatus for dispensing ice in flaked, crushed, shaved or similar form, a first relatively rotatable ice moving member, a second relatively rotatable ice moving member rotatable about an axis different from the axis of rotation of said first mentioned member, a third relatively rotatable ice moving member rotatable about an axis different from the axis of rotation of both said first and second members, means for simultaneously rotating two of said members for causing ice to be moved from a storage area toward a delivery area, means for selectively rotating the other of said members for causing ice to be moved along a delivery path toward an ice receptacle, and control means for selectively orienting said second member at the end of each vend cycle so as to prevent undesirable movement of melt water along said delivery path between vend cycles.

59. In an apparatus for dispensing ice in flaked, crushed, shaved or similar form, a relatively rotatable ice moving assembly adapted to receive ice from a source thereof and cause said ice to move toward an ice dispensing area, said assembly including a rotatable rotor member and a plurality of ice moving elements arranged circumferentially around said rotor member and extending radially outwardly therefrom and independently rotatably mounted thereon, said elements including ice engaging faces normally arranged at a first position relative to ice being moved thereby and means permitting selective rotational movement of said elements from said first position toward a second position causing ice to be moved toward said dispensing area.

* * * * *